United States Patent [19]

Gach et al.

[11] Patent Number: 4,747,499

[45] Date of Patent: May 31, 1988

[54] TAMPER INDICATING CLOSURE WITH ADHESIVE-ATTACHED GASKET

[75] Inventors: Peter P. Gach; Randall K. Julian, both of Evansville, Ind.

[73] Assignee: Sunbeam Plastics Corporation, Evansville, Ind.

[21] Appl. No.: 693,328

[22] Filed: Jan. 22, 1985

Related U.S. Application Data

[63] Continuation-in-part of Ser. No. 465,817, Feb. 14, 1983, abandoned, which is a continuation-in-part of Ser. No. 439,742, Nov. 8, 1982.

[51] Int. Cl.[4] ..... B65D 51/22

[52] U.S. Cl. ..... 215/250; 215/276; 215/350; 220/377

[58] Field of Search ..... 215/203, 204, 209, 211, 215/213, 219, 220, 230, 231, 232, 247, 250, 251, 252, 253, 257, 258, 329, 331, 341, 343, 346, 349, 350, 351, 366; 220/82 R, 219, 253, 254, 255, 256, 258, 265, 268, 377, 378; 206/807, 459, 460; 215/276

[56] References Cited

U.S. PATENT DOCUMENTS

| | | | |
|---|---|---|---|
| 1,670,450 | 5/1928 | Henry | 215/250 |
| 1,762,342 | 6/1930 | Merolle et al. | 215/250 |
| 1,916,977 | 7/1933 | Gutmann | 215/329 X |
| 2,016,936 | 10/1935 | Waring | 215/232 |
| 2,018,061 | 10/1935 | Gillen et al. | 215/253 |
| 2,055,625 | 9/1936 | Heckel et al. | 215/347 |
| 2,068,389 | 1/1937 | Smith | 215/350 |
| 2,131,774 | 10/1938 | Waring | 215/250 |
| 2,131,775 | 10/1938 | Waring | 215/250 |
| 2,188,946 | 2/1940 | Gutmann | 215/347 |
| 2,646,183 | 7/1953 | Pellett | 215/347 |
| 2,721,686 | 10/1955 | Reifsnyder et al. | 229/515 |
| 3,489,307 | 1/1970 | Wenger | 215/351 |
| 3,501,042 | 3/1970 | Risch et al. | 215/232 |
| 3,612,325 | 10/1971 | Williams | 215/350 |
| 3,709,395 | 1/1973 | Brennan et al. | 215/329 X |
| 3,924,772 | 12/1975 | Magnani | 215/276 |
| 4,066,181 | 1/1978 | Robinson et al. | 215/256 |
| 4,094,460 | 6/1978 | Scanga et al. | 215/232 |
| 4,381,840 | 5/1983 | Ostrowsley | 215/329 |
| 4,448,345 | 5/1984 | Helms | 220/258 |
| 4,456,139 | 6/1984 | Kent | 215/252 |
| 4,461,389 | 7/1984 | Korn | 215/246 |

FOREIGN PATENT DOCUMENTS

| | | | |
|---|---|---|---|
| 208484 | 12/1955 | Australia | 215/346 |

*Primary Examiner*—Stephen Marcus
*Assistant Examiner*—Bryon Gehman
*Attorney, Agent, or Firm*—Irvin L. Groh; Alfred L. Patmore, Jr.

[57] ABSTRACT

A tamper indicating package incorporates a closure, at least a portion of which is transparent, and a seal which is bonded to the container so that the seal is visible through the closure. In some embodiments the closure is fastened also to the seal so that any movement between the closure and container results in fracture of the seal indicating tampering.

6 Claims, 3 Drawing Sheets

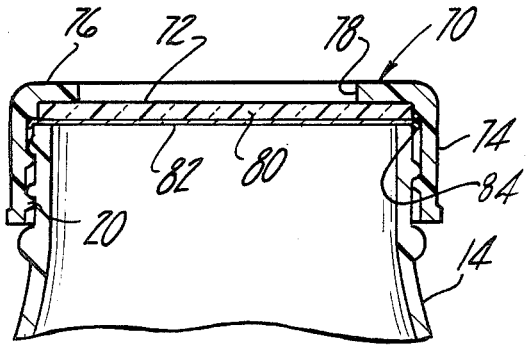
Fig-10
Fig-11
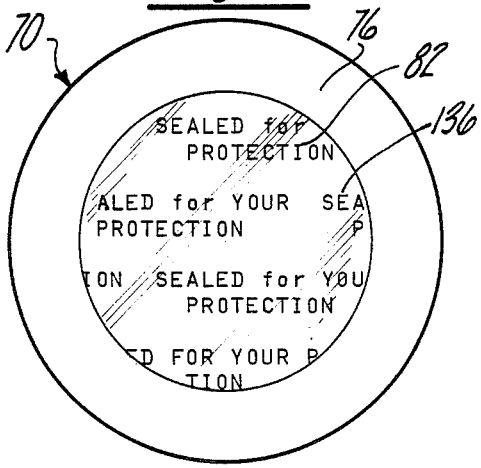
Fig-13
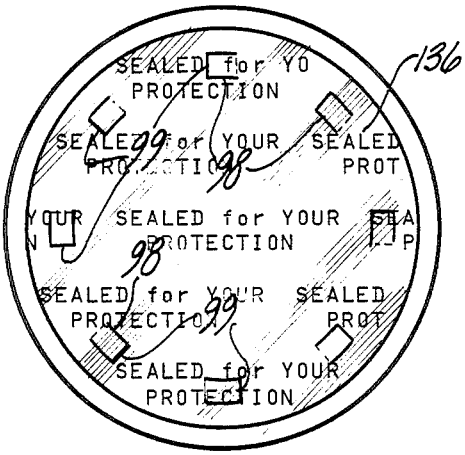
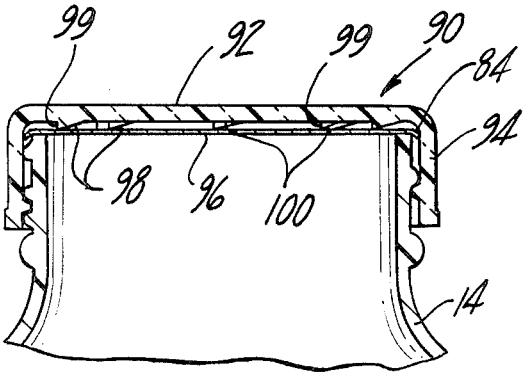
Fig-12
Fig-15
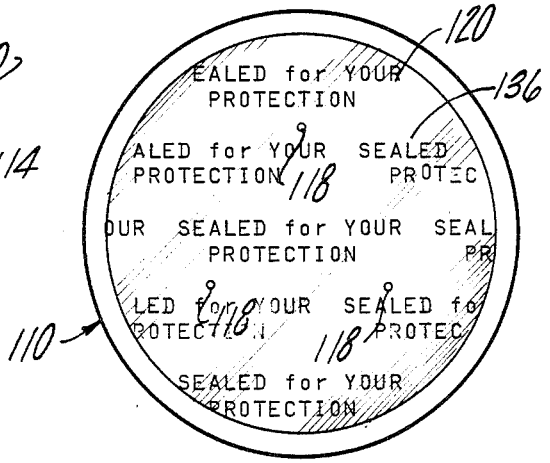
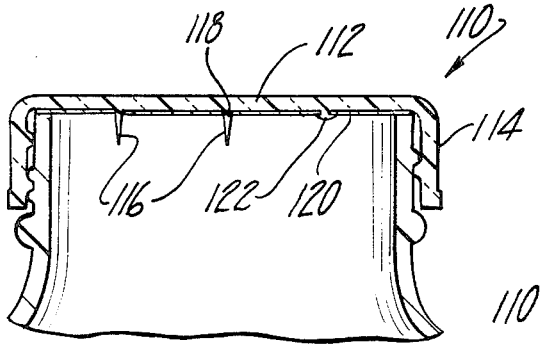
Fig-14

TAMPER INDICATING CLOSURE WITH ADHESIVE-ATTACHED GASKET

This application is a continuation-in-part of application Ser. No. 465,817 filed Feb. 14, 1983 which is now abandoned is a continuation-in-part-of application Ser. No. 439,742 filed Nov. 8, 1982.

This invention relates to closures for containers and more particularly to closures of the type which indicate tampering.

There are a large variety of closures for containers which attempt to give evidence that the container has been opened or at least been placed in a condition for opening once it has been fillcd. The purpose of such closures is to insure that consumers can be confident that a closure has remained in a closed position once it has been filled and that it has not been opened prior to its purchase. However, many of such closures can be overcome by careful manipulation.

One such form of closure utilizes a destructible seal which covers the opening to the container and is bonded to the perimeter of the opening. The seal is protected from premature damage by a cap screwed or snapped onto the container. Access to the contents of the container requires removal of the cap and puncturing the seal. Consequently, removal of the cap gives visual evidence of whether or not the container has remained sealed since it originally was filled. However, with such containers and closures, the seal can be punctured and the customer is not made aware of the condition of his purchase until the cap is removed. Also, the seal can be completely removed and unless the consumer is familiar with the packaging or has another container with which the open container can be compared, the consumer can be unaware that there has been a prior opening.

In the present invention, a tamper indicating closure can be attached to a container in any conventional manner, such as by threads or snap locks and can be any one of a number of child resistant types. The closure is made at least in part of transparent material and incorporates a seal of plastic treated foil or treated paper such as glassine. The underside of the seal is provided with a pressure sensitive adhesive or in the case of foil, it can be treated with a coating of plastic. Consequently, after a container is filled with a product, the manufacturer applies the closure to the container to bring the underside of the seal into contact with the perimeter of the opening. In the case of adhesive, this causes a bonding and in the case of plastic foils the filled container and cap can be passed through an induction field to cause bonding. In either case a seal of the contents within the container occurs and the transparent closure makes the entire seal clearly visible so its integrity can be determined especially when compared with like containers in the same display.

In a second embodiment of the invention the top of the seal has a portion bonded to the underside of the cap. Opening movement requires either rotation or axial movement of the closure relative to the container and such movement fractures the seal element so that there is visual evidence that an effort has been made to open the container by removing the cap. Again, this is particularly evident when the package of the product is on shelves of a retail outlet where comparison can be made with like packages on display. However, even a single package gives evidence that there has been an effort at prior opening by the fracture of the seal. Such fracturing of the seal is emphasized by the use of contrasting indicia or colors for opposite sides of the seal.

In other embodiments of the invention, the seal is fastened to the underside of the cap by means integral with the cap and in still another embodiment of the invention, means are provided at the underside of the cap which permits turning movement of the cap relative to the seal on a container in the closing direction but act to engage and tear the seal if an effort is made to move the cap in an opening direction. In still another embodiment, the means for making the sealing element visible also provides the secondary seal for sealing the container after the primary foil or glassine seal has been punctured and removed.

Preferred embodiments of the invention are described with reference to the drawings in which:

FIG. 10 is a cross-section view of another embodiment of the invention;

FIG. 11 is a top view of the embodiment of the inventions seen in FIG. 10;

FIG. 12 is a cross-sectional view similar to FIG. 10 showing another embodiment of the invention;

FIG. 13 is a top view of the embodiment of the invention seen in FIG. 12;

FIG. 14 is a cross-sectional view similar to FIG. 12 showing still another embodiment of the invention;

FIG. 15 is a top view of the embodiment of the invention seen in FIG. 14;

FIG. 19 is an exploded view of a clsoure forming another embodiment of the invention; and FIG. 20 is a sectional view with portions broken away showing the closure in its relationship to the container.

Figure 1:
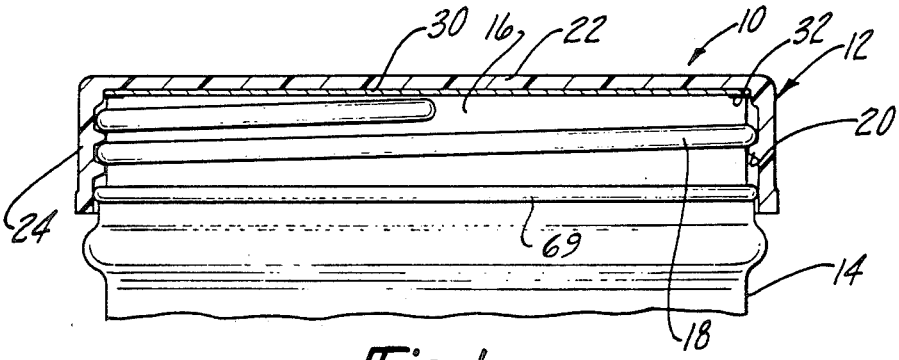
FIG. 1 is a cross-sectional view of a closure embodying the invention in closed position on the neck of a container which is shown in elevation.

A portion of a package 10 having a closure 12 embodying the invention and shown in closed position on a container 14 is illustrated in FIG. 1. The container 14 has a neck 16 provided with conventional screw threads 18 formed on the exterior of the neck 16 which are complementary to threads 20 formed on the closure 12.

The closure 12 has a flat disc shapec top 22 with a depending cylindrical skirt 24 the interior wall of which is formed with the threads 20. In the closed condition of the package 10, a seal 30 is disposed between the closure 12 and the container 14. The seal 3n is a thin membrane of treated paper such as glassine or plastic coated metal foil such as aluminum. The seal 30 is disposed within the closure 12 and has its perimeter portion 32 provided with a pressure sensitive adhesive such that when the closure 12 is applied to the container 14, the seal 30 is bonded to the sealing lip of container 14 to seal the contents within the container 14. In the case of a seal 30 made of metal foil the underside of the seal can be treated with a coating of plastic material so that after the closure 12 is placed on the container 14 for the first time, the package 10 can be passed through an electric induction field causing the heat to bond the foil to the perimeter of the neck 16.

The cap is made of transparent material and in the closed position of package 10 the seal 30 on the container 14 is clearly visible through the closure 12. For this purpose the cap preferably is made of plastic such as polypropolene which has the property of giving contact clarity. By contact clarity is meant that objects in contact such as the seal 30 are clearly visible whereas objects spaced slightly from the material are less definite. With the seal in contact with the underside of the closurc 12 the condition of the seal 30 is readily apparent. Also the position of the seal relative to the cap is less apparent in the event that the seal is slightly spaced from the closure 12 as would occur if a screw type cap has been loosened. Other plastic materials such as polyethylene also can be used to form closure 12 but are apt to give a less clear or milky appearance to objects.

After container 14 has been filled with the product to be packaged and the transparent closure 12 together with the seal 30 is brought into closing contact with the container 14 the seal 30 will be bonded to the perimeter of the neck 16 either by way of the pressure sensitive adhesive or by the subsequent induction heating of plastic coating of the metalic seal 30. Under these conditions the contents of the container 14 are sealed and the seal is visible through the transparent closure 12. When such packages 10 are displayed in side by side relationship at retail outlets, the consumer can readily view the condition of the seal through the transparent closure 12. If the seal 30 has been fractured or is absent, this indicates the possibility of tampering so that the package can be removed from the display to prevent distribution to a consumer.

In a second embodiment of the invention, a closure can be identical in all respects to the closure 12 except that a top portion of seal 30 is bonded by means indicated at 44 to an underside of the flat top 22. This bond is a permanent bond created either by adhesive in the case the seal 30 is of glassine or by fusion during induction heating in the case of plastic coated metal foil.

If desircd the transparcnt closurc 42 may havc portions such as that indicated at 46 stippled to make those portions of the closure opaque or only partially transparent. This makes it possible to provide contrasting areas concealing adhesive or screw threads and can be used to give a decorative appearance. However, a major portion of the top 44 preferably is transparent.

The seal 30 can be held in position within the closure 42 during application of the closure assembly to the container 14 during the packaging operation. The resultant package 10 is one in which the seal 30 has its perimeter bonded to the container 14 and a portion of the top of the seal bonded to closure 42. The appearance of the package 10 is as viewed in FIG. 5 in which the contents of the container are concealed by the seal 30 which in turn is clearly visible through the closure 42. The nature of the bonding is such that the attachments to the container 14 and to the closure 12 are permanent. As a consequence any relative movement of the closure 12 and container 14 will result in distortion and fracture of the seal 30.

Figure 5:
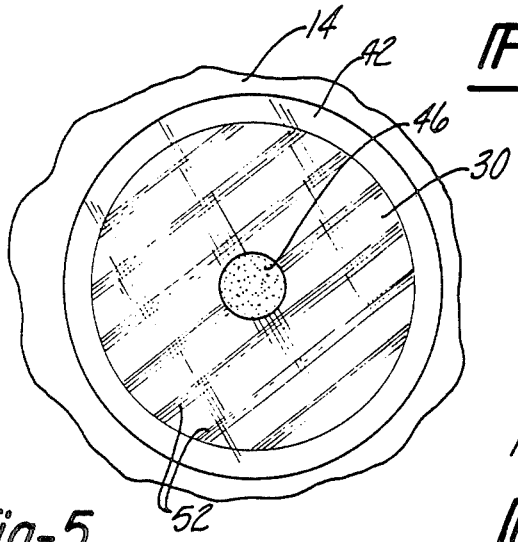
FIG. 5 is a top view of the closure and container of the embodiment the invention seen in FIGS. 2 and 3 showing the condition of the package after it is first closed after filling.

Once an effort has been made to open the package 10 by removing the closure 42 the fractured seal 30 becomes visible through the top of the closure 42 and such fracture is readily apparent particularly when compared with like containers in which the seal 30 is intact as seen in FIG. 5.

Figure 6:
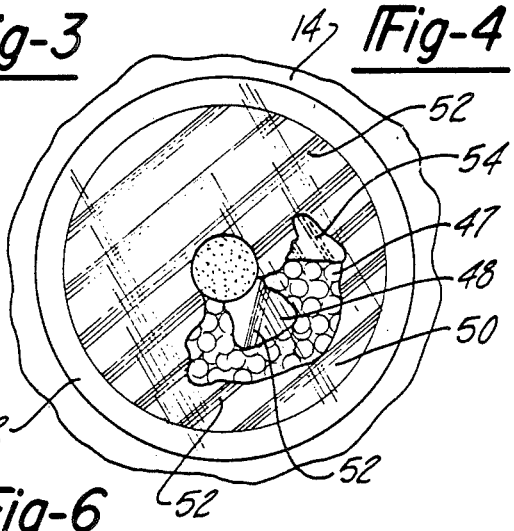
FIG. 6 is a view similar to FIG. 5 showing the condition of the package after an effort has been made to open it by movement of the closure from the container.

Upon fracture of the seal 30 it may have an appearance as viewed in FIG. 6 in which a portion of the seal 30 is torn away to make the contents 47 of the container 14 partially visible. Fragments such as that indicated at 48 may remain attached to the closure 42 and portions indicated at 50 may remain attached to the container 14. Various indicia such as contrasting printing or contrasting colors can be used to make the fracture more readily apparent. For example, with directionally disposed indicia such as the lines 52 the fragments 48 and 50 become more apparent because of the misalignment of the lines 52. Also portions of the seal 30 may be folded over as indicated at 54 in which evcnt contrasting indicia such as printing or colors on the top and bottom side of the seal 30 will make the fracture of a seal more apparent.

Figure 7:
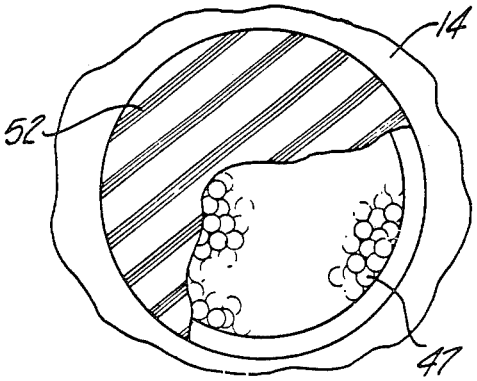
FIG. 7 is a view similar to FIG. 6 of the container with the closure removed and with a portion of the seal remaining attached to the container.
Figure 8:
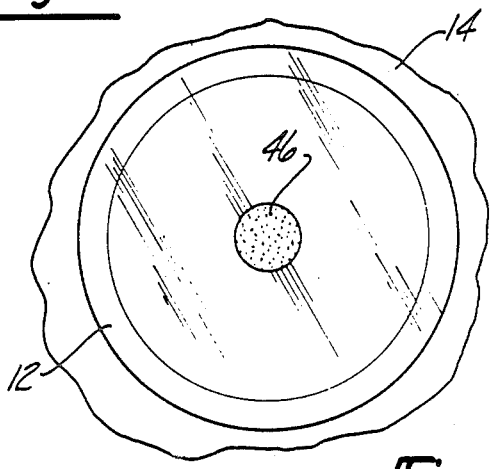
FIG. 8 is a view of the package after it has been opened and the seal has been completely removed and the closure is reattached to the container.

After thc closure 42 is completely removed from the container 14 portions of the seal 30 will remain attached to the container 14 as viewed in FIG. 7. These fragments as well as those attached to the closure 42 can then be removed with the fingers. Upon replacement of the closure 42 to the container 12 the unsealed contents of the container are visible through the transparent portions of closure 42 and the absence of the seal 30 will be readily noticeable particularly when compared with like packages 10 which remained fully sealed.

Figure 9:
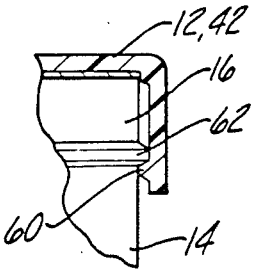
FIG. 9 is a partial view similar to FIG. 1 showing another.arrangement for holding the closure on the container.
Figure 2:
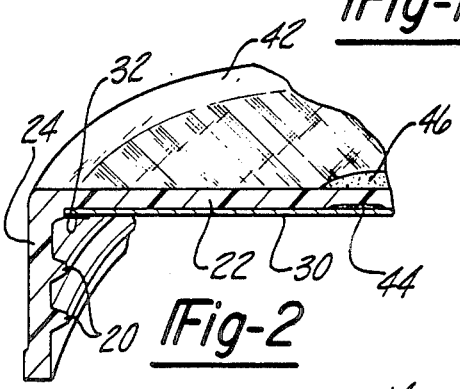
FIG. 2 is a fragmentary perspective view of one embodiment of the closure also shown in cross-section.

Although the embodiments of the invention have been disclosed in connection with a screw type closure 12 or 42, either form of closure could be of the snap type which as viewed in FIG. 9 has a lock flange 60 formed on the neck of the container 14 and a complementary locking flange 62 formed on the inside of the closure. Removal of the closure 12 or 42 requires axial movement which in the case of the closure 42 results in rupture of the seal 30 upon relative axial movement and removal. The closures 12 and 42 also can be of various child proof type having locking features and requiring predetermined orientation or squeezing before opening can occur. In all such packages the closures are made wholly or partially transparent to make the membrane seal 30 visible and relative movement of the container and closure can be used to rupture a seal.

After the primary seal 30 has been removed from the container 14 the closure 12 can be reapplied to the container 14 in which case the bead 69 coacts with the interior surface of the skirt 24 as seen in FIG. 1 to form a seal to protect the remaining contents of the container 14.

Referring to FIGS. 10 and 11, another embodiment of the invention is illustrated in which a closure 70 has a disc shaped top 72 with a depending cylindrical skirt 74, the interior walls of which are formed with the threads 20. The-disc shaped top 72 is made up of an annular flange 76 which is formed integrally with the skirt 74 and can be made of an opaque material. The annular flange 76 forms a port or opening 78 which is closed by a disc shaped liner 80 seated against the underside of flange 76 and within the closure 70. The liner 80 is fastened in position by any means including adhesion or snapped into position by an interference fit with the interior of skirt 7. The liner 80 is transparent and is made of relatively resilient and soft plastic, for example, a low density polyethylene with an ethylene acetate additive. This makes the liner 80 relatively soft and pliable to give it sealing characteristics and at the same time allows it to be transparent.

In the closed condition of a package, a destructible seal 82 similar to the seal 30 is disposed between the closure 70 and the container 14. As in the prior embodiments of the invention, the seal 82 can be bonded by adhesive or induction heating to the sealing lip of the container 14 to seal the contents within the container 14. After the package has been filled and sealed for the first time, the seal element 82 is clearly visible through the transparent liner 80 to indicate its condition. If the seal element 82 has been fractured or is absent, tampering or prior opening is apparent and the package can be removed from the display to prevent distribution to consumers.

In normal use, the presence of absence of the seal can be noted through the transparent liner 80 and when the closure 70 is removed, the seal element can be broken and removed in its entirety to use the contents of the container 14. When only a portion of the contents are used, the closure can be replaced on the container 14 which willbring the underside of the liner 80 into sealing engagement with the lip on the neck of the container 14. In this manner, the liner 80 not only provides a means by which the primary seal 82 can be observed, but after it has been removed, the liner 80 thereafter acts as the seal for the remaining contents of the container 14.

The destructible seal 82 can be applied to the container 14 separately from the underside of closure 80 or can be temporarily assembled to the inside of the closure by an interference fit afforded by the circumferential lip 84 of seal 82 so that the closure 70 and seal 82 can be applied to the container simultaneously.

Referring to FIGS. 12 and 13, another embodiment is illustrated in the form of a closure 90 which is made of transparent plastic material and includes a disc-shaped top 92 and a cylindrical skirt 94. The closure 90 is adapted for use with a seal element 96 similar to the seal element 82 which is secured in sealed engagement with the lip of the opening of the container 14. The underside of the disc-shaped top 92 is provided with a plurality of annularly spaced teeth 98 having a sharp leading edge 99 and a tapered trailing surface 100 as considered in the direction of turning the closure 90 to a closing direction. This configuration of teeth 98 is such that with a seal element 96 seated within the closure 90, the assembly can be applied to a container 14. When the closure 90 is rotated in a closing direction, the seal element 96 can rotate therewith until it comes in contact with the sealing lip of the container 14. During such closing movement, if rotation of the seal is prevented by the closure 14, the trailing edges 100 of the teeth 98 will permit relative movement between the seal 96 and the closure 90. However, once the container 14 is closed and the seal 96 becomes bonded to the sealing lip of the container 14, any effort to rotate the closure in an opening direction will cause the sharp edges 99 of the teeth 98 to tear the sealing element 96. The torn condition of the seal element 96 becomes visible through the transparent closure 90 thereby giving an indication of tampering with the package. Similarly prior to any effort at opening movement the transparent closure 90 makes it apparent that the package with its seal element 96 is intact and unopened.

FIGS. 14 and 15 show another embodiment of the invention wherein a closure member 110 has a generally disc-shaped top 112 and a depending cylindrical skirt 114. The closure member 110 is made of transparent plastic material and the underside of the disc-shaped top 112 is provided with integral spikes 116 which receive openings 118 in a seal element 120 similar to the seal elements 30, 82, and 96 used with the prior embodiments of the invention. After the seal 120 is positioned within the closure 110 with the spikes 116 passing through the openings 118, the spikes 116 are distorted by heat to form rivet heads 122. The rivet heads 122 not only serve to hold the seal element 120 in position relative to the closure member 110 but also seal the openings 118 preventing any leakage from the container 14 through the openings 118. After the closure member 110 is applied to a container 14 and the seal element 120 becomes bonded to the lip of the opening in the container 14, any subsequent movement of the closure member 110 will damage and tear the seal element 120. The condition of the seal can be continuously observed through the transparent closure member 110 with a ruptured condition of the seal 120 indicating tampering. Spikes 116 such as those shown in FIG. 14 can be formed on the transparent disc-shaped liner 80 seen in FIG. 10 to hold seal element 82 relative to the liner 80 in the same manner that the seal 120 is secured to the closure 110 seen in FIG. 14. With such an arrangement any effort at opening will tear seal 82 to make tampering evident.

Figure 16:
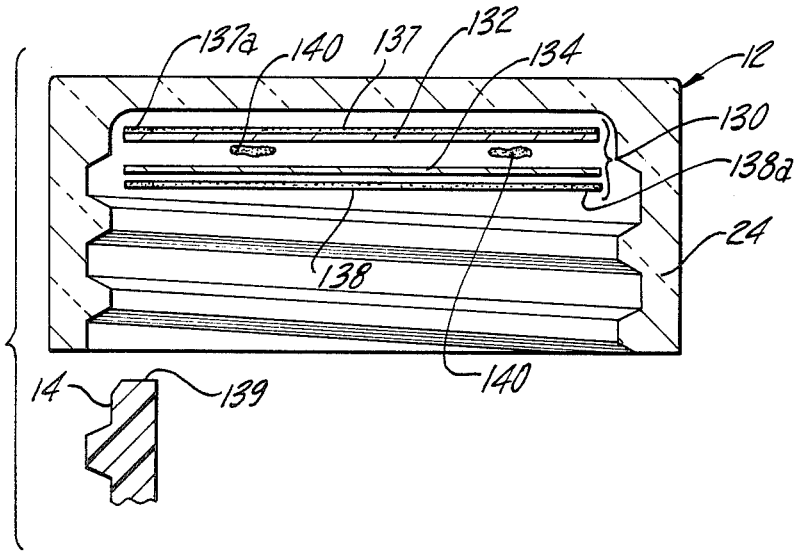
FIGS. 16, 17 and 18 are cross sectional views showing variations of seal elements used with the closures.
Figure 17:
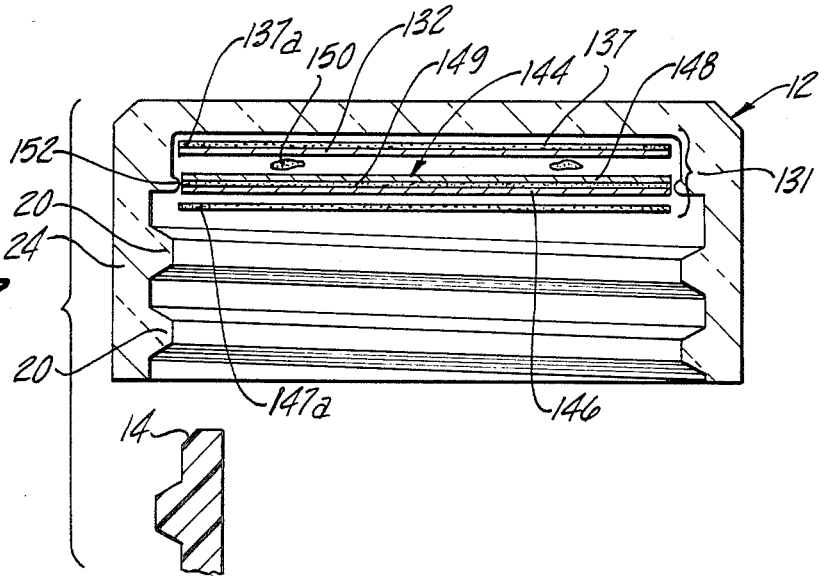

Variations of the seal elements 30, 82 and 120 used with the various closure members seen in FIGS. 1, 10, and 14, can take the form of the seal assemblies 130 illustrated in FIG. 16 or 131 in FIG. 17.

Referring first to FIG. 16, the seal element 130 is made up of an upper layer formed by a disc 132 and a lower layer formed by a disc 134. The upper disc 132 may be made of paper having indicia such as the lines 52 seen in FIGS. 6 and 7 or a repeated worded message indicated at 136 in FIGS. 11, 13, and 15. The upper surface of disc 132 is covered with a layer 137 of either pressure sensitive adhesive or with a plastic coating weldable by induction heating such that upon filling and closing a container for the first time a narrow band of adhesive or coating 137*a* is activated to fasten the seal assembly to the closure 12. The lower disc 134 is made of foil or glassine material such as used in the seals 10, 70 and 110. When made of foil a layer of either adhesive or coating 138 is applied to disc 134 which upon filling and closing a container will result in a band 138*a* of pressure sensitive adhesive 138*a* which will adhere in sealing contact with the upper lip 139 at the perimeter of an opening in a container. In the case of glassine, adhesive usually is applied to the lip 139 of the closure.

The upper and lower discs 132 and 134 are permanently fastened together by glue bond indicated at 140 and can be formed at one or more locations between the discs 132 and 134. The paper indicator disc 132 perferably is made of an opaque material which is weaker than the lower sealing disc 134. As a result, when the transparent closure member 12 is rotated in an opening direction relative to an associated container, on which sealing disc 134 is attached by adhesive or coating, the upper disc 132 and lower sealing 134 move relative to each other but the glue bond 140 resists such relative rotation causing the weaker indicator disc 132 to tear. Such tearing is apparent through the transparent closure member 12 indicating that an effort has been made to open the container with which the closure assembly is being used. Upon removal of the closure member 12, the lower sealing disc 134 remains in sealing engagement with the container and can be easily broken and removed to provide access to the contents of the container.

The seal element assembly 131 which is shown in FIG. 17 includes a lower disc assembly 114 that is substituted for the lower disc 134 seen in FIG. 16. The lower disc assembly 144 has a sealing disc 146 similar to lower disc 134 made of foil or glassine material and is fastened to a container 14 by a band of adhesive or coating 147*a* around the perimeter of the disc 146. The lower disc assembly 144 also includes a pulp backing disc 148 which is releasably attached to the sealing disc 146 by a wax-like material indicated at 149. The pulp disc 148 is fastened to the upper disc 132 which is fastened to closure 12 by adhesive band 137 by a glue bond indicated at 150 which permanently fastens the pulp disc 148 to the upper disc 132.

As with the closure assembly seen in FIG. 16 removal of the closure 12 seen in FIG. 17 from a container 14 requires rotation of the closure member during which time the upper disc 132 is rotated relative to the lower disc assembly 114 causing the weaker upper disc 132 to fracture. The fracture is visible through the transparent closure 12 thereby indicating that an effort has been made to open the container.

The inner surface of the skirt 24 above the threads 20 is provided with an annular bead 152 which engages the pulp disc 148 during upward movement of the closure member 12 relative to the container 14 causing the pulp disc 148 to separate from the lower sealing disc 146 which remains attached to the container by adhesive 147*a*. The seal disc 146 can be broken and completely removed to make the contents of the container available.

Figure 18:
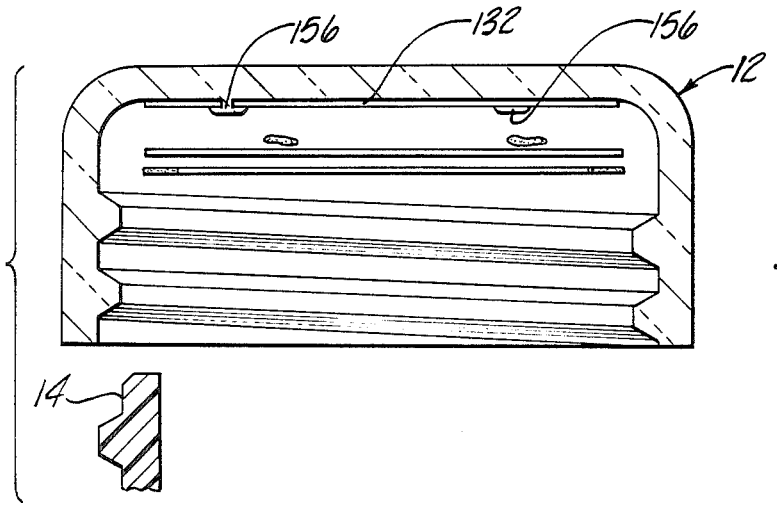

With both of the tamper indicating closure assemblies 130 and 131 seen in FIGS. 16 and 17, the upper indicator disc 132 can be permanently fastened to the closure member 12 without the use of the bead of adhesive 136 by employing a mechanical bond as illustrated at 156 in FIG. 18. This mechanical bond 156 is formed by portions integral with the closure member 12 passing through openings in the upper disc 132 to form rivets 156 in the same manner as the rivets 116, 120 seen in FIG. 14. When such mechanical bonds are formed, the opposed upper disc 132 and the lower disc 134 or pulp disc 148 avoid any potential leakage that might possibly occur around, the rivets 156 due to the material passing through the upper disc 132.

Figure 3:
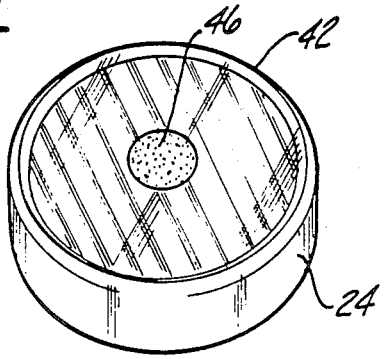
FIG. 3 is a perspective view of the entire closure seen in FIG. 2.
Figure 4:
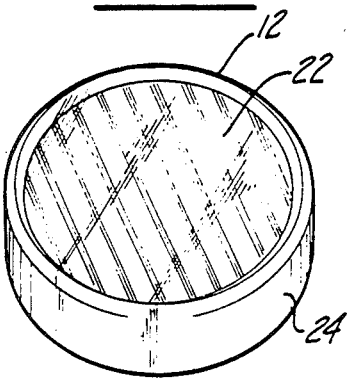
FIG. 4 is a perspective view of another embodiment of the invention.

The layered seal assemblies of FIGS. 16, 17 and 18 conceal the glue portion 140 which has an irregular contour and might be regarded as unsightly if not concealed by opaque portions of the closure such as those indicated at 46 in FIG. 3.

Both of the seal element assemblies 130 and 131 can be used with the tamper indicating closure 70 seen in FIGS. 10 and 11 using either the upper adhesive bead 136*a* of adhesive-coating or the mechaical bond 156 afforded by rivets in FIGS. 16 through 18 to fasten the seal element assemblies to the liner 80.

Still another embodiment of the invention is disclosed in FIGS. 19 and 20 in which the closure 160 includes a cylindrical body member 162 having internal threads 164 for engagement with complementary threads 166 on a neck of a container 168. The cylindrical body member 162 is open at is opposite ends to form a lip 170 at the lower open end to receive the neck of the container 168. The opposite end of the body member 162 is provided with annular flange 172 forming an opening 174 to receive a cap member 176. The cap member 176 is generally hat shaped and the brim portion is formed by an annular flange 178. Flange 178 merges with an axially extending tubular portion 180 which projects through the opening 174. The upper end of the cap member 176 is provided with annular bead 182 which together with the flange 178 forms a radially outwardly opening cap groove 184 which receives the flange 172 of the body member 162.

The body member 162 is provided with an internal shoulder 186 which acts with the flange 172 of the body member to form a body groove 188 receiving the cap flange 178.

The cap member 176 is made of transparent polyethylene, a relatively soft material and in assembly of the closure 160 is snapped into position so that it is free to rotate with the body member flange 172 in the body groove 184 and the cap flange 178 in the body groove 188. The cap member 176 is formed with a central portion 190 connected by frusto-conical wall portion 192 with the upper end of the tubular portion 180. This places the bottom surface of the central portion 190 in alignment with the bottom portion of the flange 178 of the cap member 176. Also the construction forms an annular groove 194 which separates the central portion 190 from flange 178.

The closure 160 also includes an adhesive faced printed liner 200 which adheres to the underside of cap member 176 as it is held within body member 162.

The complete closure assembly 160 includes the body member 162, the cap member 176 and the liner 200. Upon application of the assembly 160 to the container, the closurew 160 is rotated to bring the threads 164 and 166 into engagement with each other so that the closure assembly 160 moves axially downwardly relative to the container 168. Upon engagement of the underside of the liner 200 with the top lip 202, of container 168 the cap member 176 stops rotating and remains stationary relative to th e container 168 while the body member 162 continues to rotate until the flange 172 of body member 162 firmly engages the top of flange 178 of cap member 176 and presses the cap member 176 into tight sealing engagement with the container 168. Under these conditions the disc liner is clearly visible through the cap member 176 to indicate that the package is in its initially closed position.

In the initially closed condition, the disc liner 200 is firmly attached to both the container 168 and to the cap member 176. Consequently, any rotation of the body member 162 is an opening direction will move the cap member 176 axially and cause fracture of the disc liner 200. If the closure 160 should be reclosed, such a fracture will be visible through the cap member 176 to make tampering apparent. When the closure is fully removed, the disc liner 200 can be completely removed from the container 168 for dispensing of the contents of the container and thereafter the closure, which now will consist of the body member 162 and the cap member 176 can be used repeatedly to open and close the container 168. In a closed condition, the soft polyethylene cap member 176 and particularly the flange 178 acts as a liner to seal the container.

The disc shaped seal element 200 can be made similar to the seals 30 and 82 of the prior embodiments, and as liner 80 of closure 70, the seal 200 can be bonded by adhesive or induction heating to the sealing lip 202 of the container 168 and can be bonded by adhesive or the like to the central portion 190 of the cap member 176 In addition the cap member 176, like the liner 80, is made of transparent, relatively resilient and soft plastic. For example, a low density, polyethylene with an ethylene acetate additive to make the liner relatively soft and pliable giving it, not only transparency, but also a softness for sealing characteristics.

A tamper indicating closure has been provided in which a partially or fully transparent closure has a breakable seal that becomes bonded to a container so that the seal and its condition is readily visible through the closure. In some embodiments, means are provided to coact between the seal and the closure so that any movement of the closure relative to the seal once it has been affixed to the container becomes apparent through the transparent closure. Also, embodiments are provided with secondary seals or liners which become operative when the primary seal has been removed so that the closure can be resealed to protect its remaining contents.

The embodiments of the invention in which an exclusive property or privilege is claimed are defined as follows:

1. A tamper indicating closure assembly for use with a threaded container having an opening, the combination comprising: a closure member having a generally disc-shaped top with an annular portion surrounding a central opening and a cylindrical skirt extending therefrom having internal threads for engaging said container threads; a transparent disc-shaped liner element engageable with said annular portion to close said opening; a seal element for closing said opening in a container, said seal element being positioned in contacting relationship with the underside of said disc-shaped liner element and within said cylindrical skirt; and adhesive means on the underside of said seal element for bonding said seal element to container, said seal element being movable with said closure member into sealing engagement with a container having at least a portion continuously visible through said transparent liner element and said closure member opening to indicate the condition of said seal element, and upon removal of said seal element said liner element being engageable with said container for sealingly closing said container opening.

2. The tamper indicating closure assembly of claim 1 in which said closure member is opaque and is made of a relatively hard material and wherein said transparent liner element is made of a relatively softer material.

3. The tamper indicating closure assembly of claim 2 wherien said transparent liner element is made of a low density polyethylene material.

4. The tamper indicating closure assembly of claim 1 wherein said liner element is supported on said closure member for rotation relative thereto.

5. The tamper indicating closure assembly of claim 4 wherein said seal element is attached to the underside of said liner element and upon application of said closure assembly to said container, said liner element and said seal element remaining stationary relative to said container during closing rotation of said closure member, and said liner element moving axially with said closure member upon unthreading of said closure member from the container to damage said seal element.

6. The tamper indicating closure assembly of claim 4 wherein said rotatable liner support includes an axially extending tubular portion on said liner element which projects through said central opening and an annular bead at the end of said tubular portion which coacts with the annular portion of said closure member.

* * * * *